US008810136B2

(12) United States Patent
Ohiro

(10) Patent No.: US 8,810,136 B2
(45) Date of Patent: Aug. 19, 2014

(54) LED DRIVE CIRCUIT

(75) Inventor: Hidekazu Ohiro, Wakayama (JP)

(73) Assignee: NK Works Co., Ltd., Wakayama (JP)

( * ) Notice: Subject to any disclaimer, the term of this patent is extended or adjusted under 35 U.S.C. 154(b) by 141 days.

(21) Appl. No.: 13/331,585

(22) Filed: Dec. 20, 2011

(65) Prior Publication Data

US 2012/0161638 A1 Jun. 28, 2012

(30) Foreign Application Priority Data

Dec. 27, 2010 (JP) ..... 2010-289760

(51) Int. Cl.
*H05B 41/00* (2006.01)
*H05B 33/08* (2006.01)

(52) U.S. Cl.
CPC ..... *H05B 33/083* (2013.01)
USPC ..... 315/122; 315/121

(58) Field of Classification Search
USPC ..... 315/122
See application file for complete search history.

(56) References Cited

U.S. PATENT DOCUMENTS

| | | | | |
|---|---|---|---|---|
| 7,436,125 | B2 * | 10/2008 | Mashiko | 315/224 |
| 2008/0157687 | A1 * | 7/2008 | Lin | 315/185 S |
| 2009/0134828 | A1 * | 5/2009 | Chakrabarti et al. | 318/440 |
| 2010/0060190 | A1 * | 3/2010 | Cheng | 315/291 |
| 2011/0204797 | A1 * | 8/2011 | Lin et al. | 315/161 |
| 2011/0227412 | A1 * | 9/2011 | Xu et al. | 307/24 |
| 2012/0217879 | A1 * | 8/2012 | Liu | 315/152 |

FOREIGN PATENT DOCUMENTS

| | | | |
|---|---|---|---|
| EP | 0699015 | | 2/1996 |
| EP | 2161971 | | 3/2010 |
| JP | 2006324534 | | 11/2006 |
| JP | 2012054492 | A * | 3/2012 |

OTHER PUBLICATIONS

EP Application No. 11193324.8-2006(Extended European Search Report), NK Works Co. Ltd. Mar. 14, 2012.

Karppanen, Matti, Suntio, Teuvo and Sippola, Mika, PCM-Controlled Superbuck Converter with Super Performance and Surprises, 2008 IEEE, pp. 3206-3212.

* cited by examiner

*Primary Examiner* — Douglas W Owens
*Assistant Examiner* — Monica C King
(74) *Attorney, Agent, or Firm* — McDonald Hopkins LLC

(57) ABSTRACT

An LED drive circuit that can increase the amount of light with a compact structure. This circuit includes series-connected LEDs, first and second DC power supplies connected in series so as to apply a forward bias to the LEDs, a coil that is series-connected with the LEDs and can accumulate energy from current generated by the DC power supplies, a rectifying element whose cathode is connected between the DC power supplies, a transfer switching element connected to the anode of the rectifying element, and a control apparatus for controlling the transfer switching element. A first closed circuit is formed by the LEDs, the DC power supplies, and the coil when the transfer switching element is switched on by the control apparatus, and a second closed circuit is formed by the LEDs, the second DC power supply, the coil, and the rectifying element when the transfer switching element is switched off.

4 Claims, 2 Drawing Sheets

LED DRIVE CIRCUIT

TECHNICAL FIELD

The present invention relates to an LED drive circuit for driving LEDs.

BACKGROUND ART

The circuit shown in FIG. 2 is a conventionally known LED drive circuit for driving LEDs. PTL 1 is a known example of literature that discloses such a circuit.

The LED drive circuit 100 shown in FIG. 2 includes multiple LEDs 101 and a DC power supply 102 that is connected in series to the LEDs 101. The LED drive circuit 100 also includes a coil 103, a rectifying element 104, a transfer switching element 105, a current sensing resistor 106, and a control apparatus 107.

The LEDs 101 are connected in series and emit light when a forward bias is applied. Also, the DC power supply 102 is disposed so as to apply a forward bias to the LEDs 101, with one end (the negative terminal) being connected to a ground G, and the other end (the positive terminal) being connected to the anode side of the LEDs 101.

The coil 103 is connected to the cathode side of the LEDs 101, and is connected in series with the LEDs 101 and the DC power supply 102. This coil 103 can accumulate energy from current generated by operation of the DC power supply 102, and can also discharge such energy. The rectifying element 104 is made up of a diode that allows current to flow in only the forward direction. The cathode side of the diode is connected between the DC power supply 102 and the LEDs 101, and the anode side is connected to the coil 103.

One end of the transfer switching element 105 is connected between the coil 103 and the rectifying element 104, and the other end is connected to the ground G. The transfer switching element 105 is configured so as to be capable of on/off switching. When the transfer switching element 105 is on, a first closed circuit 111 is formed by the DC power supply 102, the LEDs 101, and the coil 103, and when the transfer switching element 105 is off, a second closed circuit 112 is formed by the LEDs 101, the coil 103, and the rectifying element 104. The current sensing resistor 106 is disposed in order to sense the current value of the current flowing in the LED drive circuit 100. The control apparatus 107 is configured so as to be able to sense the current flowing in the current sensing resistor 106, and control the on/off state of the transfer switching element 105 based on the sensing.

With the LED drive circuit 100 having such a configuration, first, when the control apparatus 107 is operated, the control apparatus 107 switches on the transfer switching element 105, and thus the first closed circuit 111 is formed by the DC power supply 102, the LEDs 101, and the coil 103. When the first closed circuit 111 is formed, a forward bias is applied to the LEDs 101, and the LEDs 101 emit light. Also, since current is flowing in the LED drive circuit 100, current flows to the coil 103, and energy is stored in the coil 103 from such current.

Subsequently, when the current value of the first closed circuit 111 reaches a predetermined upper limit target value, the control apparatus 107 switches off the transfer switching element 105 based on the current sensed in the current sensing resistor 106. The first closed circuit 111 is therefore cut off, and the second closed circuit 112 is formed by the LEDs 101, the coil 103, and the rectifying element 104. When the second closed circuit 112 is formed, a forward bias is applied to the LEDs 101 using the energy accumulated in the coil 103, and the LEDs 101 emit light. Specifically, although power is no longer supplied by the DC power supply 102 when the second closed circuit 112 is formed and the first closed circuit 111 is cut off, a constant current continues to flow in the LED drive circuit 100 due to the discharge of energy accumulated by the coil 103. Accordingly, the LEDs 101 continue to emit light. At this time, the coil 103 attempts to continue to discharge a constant current to the second closed circuit 112, and therefore counter-electromotive force for the continued discharge of a constant current is generated in the coil 103.

Thereafter, when the current value of the second closed circuit 112 reaches a predetermined lower limit target value, the control apparatus 107 again switches on the transfer switching element 105 based on the current sensed in the current sensing resistor 106, and the first closed circuit 111 is formed. Accordingly, the DC power supply 102 applies a forward bias to the LEDs 101, and the LEDs 101 continue to emit light.

CITATION LIST

Patent Literature

Patent Literature 1: JP 2006-324534A

SUMMARY OF INVENTION

Technical Problem

With the LED drive circuit 100 described above, if there is a desire to increase the amount of light emitted by the LEDs 101, there are cases where the number of LEDs 101 is increased, or the luminance of the LEDs 101 is increased. Also, in such a case, the voltage (electromotive force) of the DC power supply 102 in the LED drive circuit 100 needs to be increased in order to reliably cause the large number of LEDs 101 or the high-luminance LEDs 101 to emit light.

However, there is the problem that when the voltage (electromotive force) of the DC power supply 102 is increased in order to increase the amount of light, the coil 103 is subjected to a large burden. Specifically, with the LED drive circuit 100 described above, when there is a switch from the first closed circuit 111 to the second closed circuit 112, counter-electromotive force is generated in the coil 103 in order to continue discharging a constant current to the second closed circuit 112, and there is the problem that if the voltage (electromotive force) of the DC power supply 102 is increased, a large amount of counter-electromotive force is generated in the coil 103 when circuit switching is performed. Specifically, when power is no longer supplied by the DC power supply 102 due to the first closed circuit 111 being cut off, the coil 103 attempts to discharge a commensurate amount of current in order to compensate for the shortage, and if the voltage of the DC power supply 102 is increased, the power supply shortage commensurately increases, and therefore the burden that the coil 103 is subjected to increases. For this reason, in the case of increasing the voltage of the DC power supply 102 in order to increase the amount of light, it is necessary to also increase the performance of the coil 103 in order to be able to withstand the burden, and this results in the problem that the coil 103 increases in size.

The present invention has been achieved in order to solve the aforementioned problems, and an object thereof is to provide an LED drive circuit that enables increasing the amount of light with a compact structure.

Solution to Problem

The present invention is an LED drive circuit for solving the aforementioned problems, and the LED drive circuit includes: a plurality of LEDs that are connected in series; a first DC power supply and a second DC power supply that are connected in series so as to apply a forward bias to the plurality of LEDs; a coil that is connected in series with the plurality of LEDs and can accumulate energy from current generated by the first DC power supply and the second DC power supply; a rectifying element whose cathode is connected between the first DC power supply and the second DC power supply; a transfer switching element that is connected to an anode of the rectifying element; and a control apparatus for controlling the transfer switching element, wherein a first closed circuit is formed by the plurality of LEDs, the first DC power supply, the second DC power supply, and the coil when the transfer switching element is switched on under control of the control apparatus, and a second closed circuit is formed by the plurality of LEDs, the second DC power supply, the coil, and the rectifying element when the transfer switching element is switched off under control of the control apparatus.

Also, it is preferable that in the LED drive circuit, a voltage of the second DC power supply is lower than a required voltage of the second closed circuit, and a sum of a voltage of the first DC power supply and the voltage of the second DC power supply is greater than a required voltage of the first closed circuit.

According to this configuration, when the first closed circuit is formed, a forward bias is applied to the LEDs using the voltage generated by the first DC power supply and the second DC power supply, and the LEDs emit light. Also, current flows to the coil due to the flow of current in the LED drive circuit as a result of the operation of the first DC power supply and the second DC power supply, and energy is accumulated in the coil from such current. Also, when the second closed circuit is formed, a forward bias is applied to the LEDs using the voltage generated by the second DC power supply and the energy accumulated in the coil, and the LEDs emit light. At this time, although power is no longer supplied by the first DC power supply when the second closed circuit is formed and the first closed circuit is cut off, a constant current continues to flow in the LED drive circuit due to the discharge of the energy accumulated by the coil. As a result, the coil attempts to continue to discharge a constant current to the second closed circuit, and therefore counter-electromotive force for the continued discharge of a constant current is generated in the coil. However, since current is applied to the second closed circuit using the electromotive force of the second DC power supply in cooperation with the counter-electromotive force of the coil, instead of using solely the counter-electromotive force, there is no need for current to be applied using solely the counter-electromotive force of the coil. Accordingly, the counter-electromotive force generated in the coil can be reduced. This enables suppressing the counter-electromotive force generated in the coil to a low value even if the luminance of the individual LEDs is increased or the number of LEDs is increased in order to increase the amount of light. As a result, the size of the coil can be reduced, and the amount of light emitted by the LEDs can be increased. The LED drive circuit of the present invention therefore enables increasing the amount of light with a compact structure.

Also, it is preferable that the LED drive circuit further includes: a voltage sensing element for sensing a voltage drop in the plurality of LEDs; and a cut-off switching element for cutting off the first closed circuit and the second closed circuit, wherein the control apparatus controls the on/off state of the cut-off switching element based on the voltage sensing performed by the voltage sensing element.

Also, it is preferable that the plurality of LEDs are each an ultraviolet LED, and the LED drive circuit is disposed in an ultraviolet irradiation apparatus.

Advantageous Effects of Invention

According to an LED drive circuit of the present invention, it is possible to increase the amount of light with a compact structure.

DESCRIPTION OF EMBODIMENTS

Figure 1:
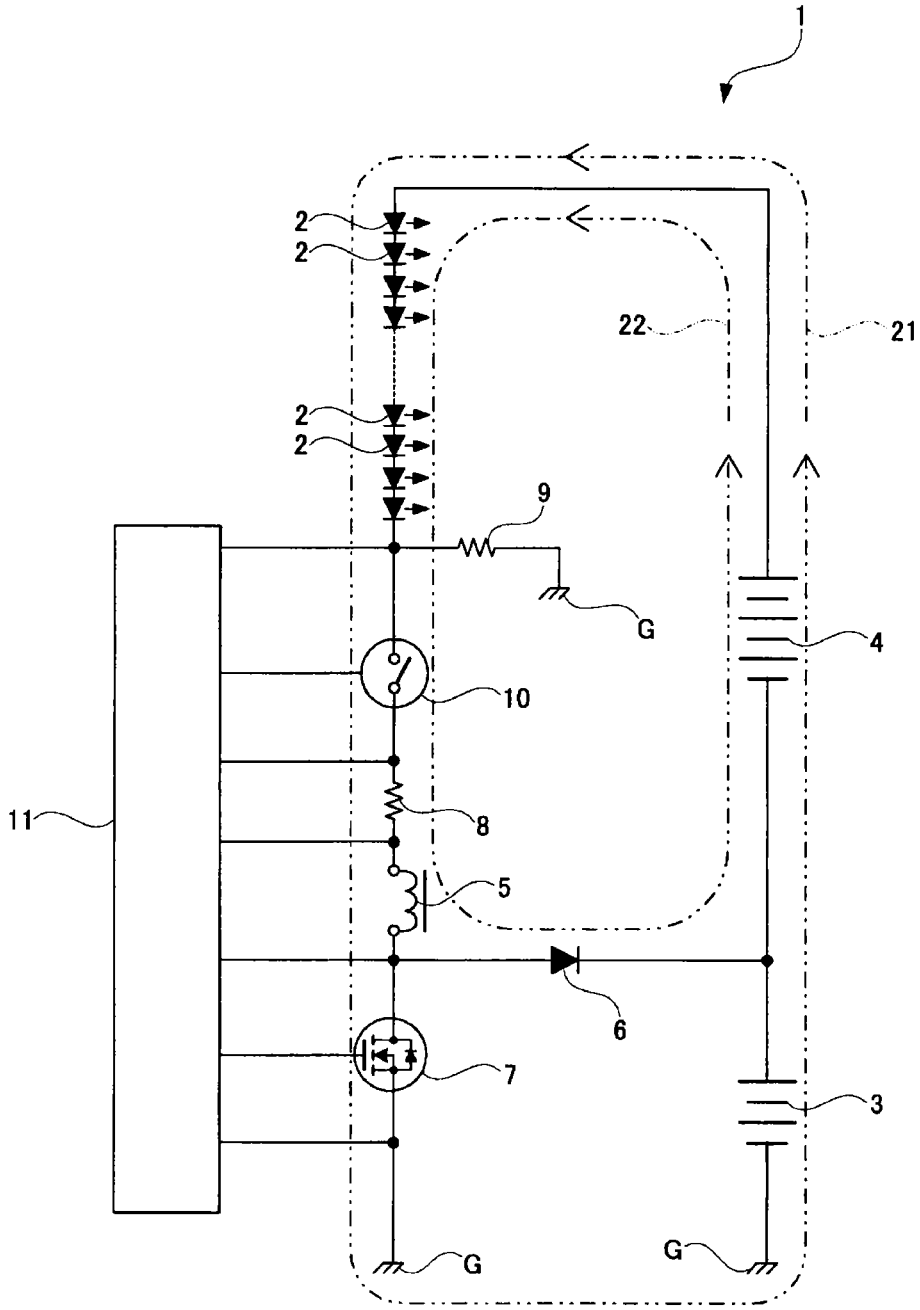
FIG. 1 is a circuit diagram of an LED drive circuit according to an embodiment of the present invention.
Figure 2:
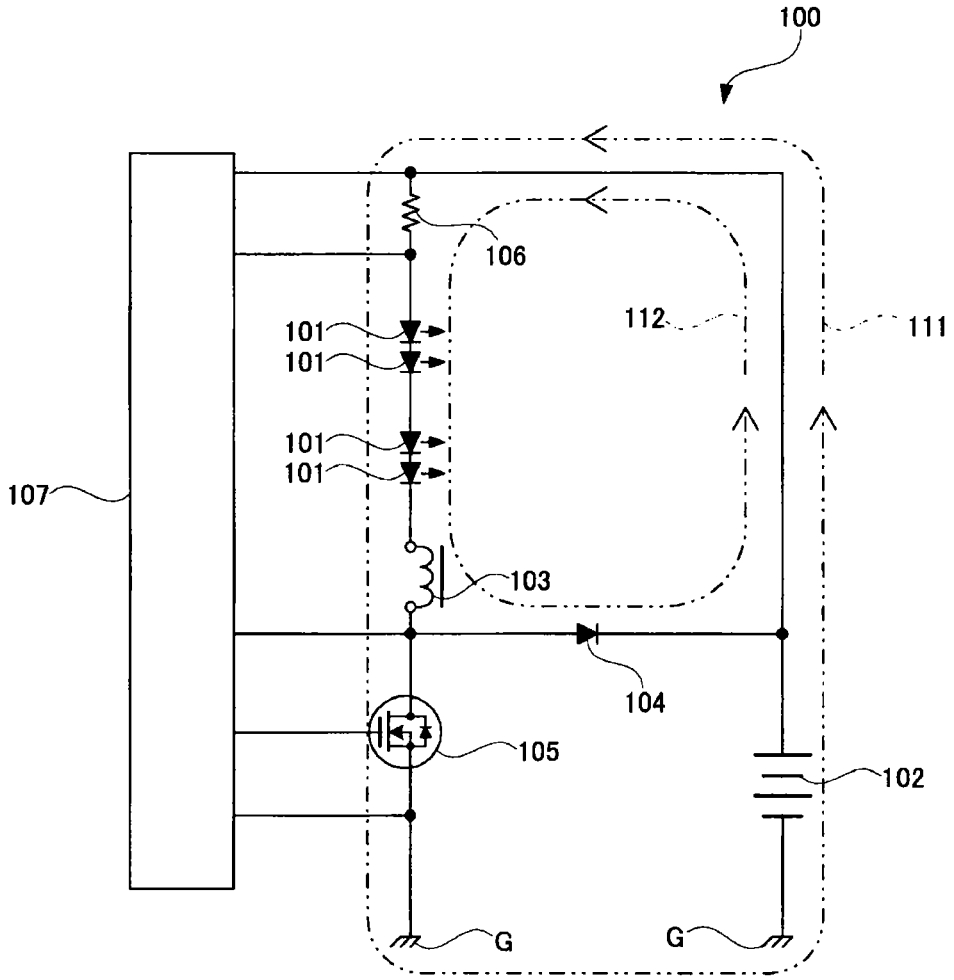
FIG. 2 is a circuit diagram of a conventional LED drive circuit.

Below is a description of an embodiment of the present invention with reference to the attached drawings. FIG. 1 is a circuit diagram of an LED drive circuit according to the embodiment of the present invention. As shown in FIG. 1, an LED drive circuit 1 includes multiple LEDs 2 that are connected in series, and a first DC power supply 3 and a second DC power supply 4 that are connected in series to the LEDs 2. The LED drive circuit 1 also includes a coil 5, a rectifying element 6, a transfer switching element 7, and a current sensing resistor 8. The LED drive circuit 1 furthermore includes a voltage sensing resistor 9, a cut-off switching element 10, and a control apparatus 11.

In the present embodiment, ultraviolet light emitting diodes (UV-LEDs) are used as the LEDs (Light-Emitting Diodes) 2, and the LEDs 2 emit light when a forward bias is applied. Besides UV-LEDs, various types of LEDs can be used as the LEDs 2, such as white LEDs, surface-mount (chip-type) LEDs, and round-type LEDs. Also, the LEDs 2 are disposed so as to all face the same direction, and are connected to each other in series.

The first DC power supply 3 and the second DC power supply 4 are connected in series, and are disposed so as to apply a forward bias to the LEDs 2. One end (the negative terminal) of the first DC power supply 3 is connected to a ground G, and the other end (the positive terminal) is connected to one end (the negative terminal) of the second DC power supply 4. Also, one end (the negative terminal) of the second DC power supply 4 is connected to the positive terminal of the first DC power supply 3, and the other end is connected to the anode side of the LEDs 2. The first DC power supply 3 and the second DC power supply 4 can each be constituted by a single power supply, or be constituted by connecting multiple power supplies. Also, the voltage of the first DC power supply 3 and the second DC power supply 4 can be appropriately adjusted.

The coil 5 is connected in series with the LEDs 2, the first DC power supply 3 and the second DC power supply 4. Also, the coil 5 is connected to the cathode side of the LEDs 2. The coil 5 is a known inductor that can accumulate energy due to the flow of current, and also discharge such energy. In the present embodiment, the coil 5 can accumulate energy from current generated by operation of the first DC power supply 3 and the second DC power supply 4, and can also discharge such energy.

The rectifying element 6 is made up of a diode that allows current to flow in only one direction (the forward direction). The cathode side of the diode is connected between the first DC power supply 3 and the second DC power supply 4. Also, the anode side of the rectifying element 6 is connected to the coil 5. A Schottky barrier diode, for example, can be used as the rectifying element 6.

One end of the transfer switching element 7 is connected between the coil 5 and the rectifying element 6, and the other end is connected to the ground G. The transfer switching element 7 is configured so as to be capable of on/off switching, and a known field effect transistor (FET), for example, can be used as the transfer switching element 7. When the transfer switching element 7 is on, a closed circuit (first closed circuit 21) is formed by the first DC power supply 3, the second DC power supply 4, the LEDs 2, and the coil 5, and when the transfer switching element 7 is off, a closed circuit (second closed circuit 22) is formed by the second DC power supply 4, the LEDs 2, the coil 5, and the rectifying element 6.

The current sensing resistor 8 is a resistor disposed in the LED drive circuit 1 in order to sense the current value of the current flowing in the LED drive circuit 1. The current sensing resistor 8 is provided in order to sense the current flowing in the first closed circuit 21 when the transfer switching element 7 is on, and sense the current flowing in the second closed circuit 22 when the transfer switching element 7 is off.

One end of the voltage sensing resistor 9 is connected to the ground G, and the other end is connected to the cathode side of the LEDs 2. The voltage sensing resistor 9 is provided in order to sense the voltage between the cathode side of the LEDs 2 and the ground G.

The cut-off switching element 10 is disposed between the coil 5 and the LEDs 2, and is configured so as to be able to cut off the LED drive circuit 1 (the first closed circuit 21 and the second closed circuit 22) when switched off. Accordingly, when the cut-off switching element 10 is switched off, current no longer flows to the LEDs 2 and the coil 5.

The control apparatus 11 is configured so as to be able to sense the current flowing in the current sensing resistor 8, and control the on/off state of the transfer switching element 7 based on the sensing. Specifically, the control apparatus 11 is configured so as to switch off the transfer switching element 7 when the current value of the current flowing in the current sensing resistor 8 has reached a predetermined upper limit target value, and to switch on the transfer switching element 7 when the current value of the current flowing in the current sensing resistor 8 has reached a predetermined lower limit target value. Accordingly, the control apparatus 11 is configured so as to maintain a steady current flowing in the LED drive circuit 1 (the first closed circuit 21 and the second closed circuit 22).

Also, the control apparatus 11 is configured so as to be able to sense the potential difference between the cathode side of the LEDs 2 and the ground G, and switch off the cut-off switching element 10 based on the sensing. Specifically, the control apparatus 11 is configured so as to switch off the cut-off switching element 10 when the voltage value of the voltage applied to the voltage sensing resistor 9 has reached a predetermined upper limit value. Accordingly, the LED drive circuit 1 (the first closed circuit 21 and the second closed circuit 22) can be cut off when the potential on the cathode side of the LEDs 2 has reached a predetermined upper limit value. This enables cutting off the LED drive circuit 1 when the voltage drop in the LEDs 2 is less than a predetermined value.

Next is a description of a method of driving the LEDs 2 with the LED drive circuit 1 having the above configuration.

First, the voltage (electromotive force) of the first DC power supply 3 and the second DC power supply 4 is set in the following way. (1) The sum (total) of the voltages (electromotive forces) of the first DC power supply 3 and the second DC power supply 4 is set to a value according to which a current flows in the first closed circuit 21. Specifically, the sum of the voltages (electromotive forces) of the first DC power supply 3 and the second DC power supply 4 is set to a value greater than the required voltage of the first closed circuit 21. Also, (2) the voltage (electromotive force) of the second DC power supply 4 is set to a value according to which a target current for causing the LEDs 2 to emit light does not flow to the second closed circuit 22 with that voltage alone. Specifically, the voltage (electromotive force) of the second DC power supply 4 is set so as to on its own be less than the required voltage of the second closed circuit 22. Note that the required voltage is the voltage required to apply a current to the circuit and cause all of the LEDs 2 to emit light (required voltage=forward direction voltage (Vf) per LED 2 chip×number of connected LED 2 chips). Next, when the control apparatus 11 is operated in this state, the control apparatus 11 switches on the transfer switching element 7, and thus the first closed circuit 21 is formed by the first DC power supply 3, the second DC power supply 4, the LEDs 2, and the coil 5. When the first closed circuit 21 is formed, a forward bias is applied to the LEDs 2 using the voltages of the first DC power supply 3 and the second DC power supply 4, and the LEDs 2 emit light. Also, current flows to the coil 5 due to the flow of current in the LED drive circuit 1 as a result of the operation of the first DC power supply 3 and the second DC power supply 4, and energy is accumulated in the coil 5 from such current.

Subsequently, when the current value of the LED drive circuit 1 (first closed circuit 21) reaches a predetermined upper limit target value, the control apparatus 11 switches off the transfer switching element 7 based on the sensed current. The first closed circuit 21 is therefore cut off, and the second closed circuit 22 is formed by the second DC power supply 4, the LEDs 2, the coil 5, and the rectifying element 6. When the second closed circuit 22 is formed, a forward bias is applied to the LEDs 2 using the voltage of the second DC power supply 4 and the energy accumulated in the coil 5, and the LEDs 2 emit light. Specifically, although power is no longer supplied by the first DC power supply 3 when the second closed circuit 22 is formed and the first closed circuit 21 is cut off, current continues to flow in the LED drive circuit 1 due to the discharge of the energy accumulated by the coil 5. In other words, the coil 5 operates so as to maintain a steady current flowing in the LED drive circuit 1 by preventing the current flowing in the LED drive circuit 1 from decreasing due to the first DC power supply 3 being cut off, and therefore a constant current continues to flow in the LED drive circuit 1. Accordingly, the LEDs 2 continue to emit light.

Here, since the coil 5 operates so as to continue discharging a constant current to the LED drive circuit 1 (second closed circuit 22), counter-electromotive force for continuing to discharge a constant current is generated in the coil 5. However, since the second DC power supply 4 is provided in the second closed circuit 22, and the coil 5 discharges current to the second closed circuit 22 in cooperation with the second DC power supply 4, the burden to which the coil 5 is subjected does not increase. In other words, the coil 5 attempts to discharge a constant current to the circuit in order to compensate for the shortage of electromotive force resulting from the first DC power supply 3 being cut off, but since current is applied to the second closed circuit 22 using the electromotive force of the second DC power supply 4 in cooperation with the counter-electromotive force of the coil 5, instead of using solely the counter-electromotive force, there is no need for current to be applied using solely the counter-electromotive force of the coil 5. This enables reducing the counter-electromotive force generated in the coil 5.

Thereafter, when the current value of the LED drive circuit 1 (second closed circuit 22) reaches a predetermined lower limit target value, the control apparatus 11 again switches on the transfer switching element 7 based on the sensed current, and the first closed circuit 21 is formed again. Accordingly, the first DC power supply 3 and the second DC power supply 4 apply a forward bias to the LEDs 2, and the LEDs 2 continue to emit light.

The control apparatus 11 also senses the voltage applied to the voltage sensing resistor 9, and when the sensed voltage exceeds a predetermined upper limit value, the control apparatus 11 switches off the cut-off switching element 10. Accordingly, the voltage drop in the LEDs 2 is indirectly sensed, and the LED drive circuit 1 is cut off based on the result of such sensing.

As described above, such an LED drive circuit 1 enables reducing the counter-electromotive force generated in the coil 5 when the second closed circuit 22 is formed. This enables suppressing the counter-electromotive force generated in the coil 5 to a low value even if the luminance of the individual LEDs 2 is increased or the number of LEDs 2 is increased in order to increase the amount of light. This consequently eliminates the need to raise the withstanding performance of the coil 5. Accordingly, the size of the coil 5 can be reduced, and the amount of light emitted by the LEDs can be increased. The LED drive circuit 1 of the present invention therefore enables increasing the amount of light with a compact structure.

In this way, although conventionally the voltage of the power supply has simply been increased in order to increase the amount of light, with the present invention, the LED drive circuit 1 is configured with separate power supplies, and therefore by adjusting the voltages (electromotive forces) of the first DC power supply 3 and the second DC power supply 4, it is possible to increase the amount of light emitted by the LEDs 2 while suppressing the counter-electromotive force generated in the coil 5.

Also, according to the LED drive circuit 1, the voltage sensing resistor 9 and the cut-off switching element 10 are provided, thus enabling sensing the voltage drop in the LEDs 2 and cutting off the circuit when the sensed value is less than a predetermined value. This enables preemptively preventing a high counter-electromotive force from being generated in the coil 5.

Also, the forward direction voltage of the rectifying element 6 can be reduced by using a Schottky barrier diode as the rectifying element 6, thus making it possible to increase the speed of switching operations performed by the transfer switching element 7.

Although an embodiment of the present invention has been described above, the specific form of the present invention is not limited to the above embodiment.

For example, although the transfer switching element 7 and the cut-off switching element 10 are controlled by the one control apparatus 11 in the above embodiment, a configuration is possible in which separate control apparatuses 11 are provided, and the transfer switching element 7 and the cut-off switching element 10 are respectively controlled by the separate control apparatuses.

Also, although the control apparatus 11 controls the on/off state of the transfer switching element 7 by sensing the current flowing to the current sensing resistor 8 in the above embodiment, this embodiment is not limited to this configuration, and a configuration is possible in which on/off timing is set in advance, and the transfer switching element 7 is controlled based on such timing.

Also, there is no particular limitation on the apparatus to which the above-described LED drive circuit 1 is applied, and examples of such apparatuses to which the LED drive circuit 1 can be applied include an ultraviolet irradiation apparatus for printing, an irradiation apparatus for curing a resist film on a printed-circuit board, and an irradiation apparatus for curing a coating material. Also, this LED drive circuit 1 is particularly effective in the case where the space for installing the LED drive circuit 1 is limited regardless of the fact that a large amount of light is necessary. For example, the LED drive circuit 1 is particularly effective in the case of being installed in an ultraviolet irradiation apparatus for printing or the like.

Also, the voltage upper limit value used when switching off the cut-off switching element 10 can be calculated using the voltages of the first DC power supply 3 and the second DC power supply 4 as well as the required voltage of the LEDs 2. Also, the control apparatus 11 may switch off the cut-off switching element 10 based on a program that has been set in advance.

Also, although the coil 5 is connected to the cathode side of the LEDs 2 in the above embodiment, this embodiment is not limited to this configuration, and the coil 5 may be connected to the anode side of the LEDs 2. With this configuration as well, the coil 5 can accumulate and discharge energy.

Also, in the above embodiment, an abnormality in the voltage drop of the LEDs 2 is sensed, and the control apparatus 11 switches off the cut-off switching element 10 based on such sensing, but conversely, a configuration is possible in which normality of the voltage drop of the LEDs 2 is sensed, and the control apparatus 11 switches on the cut-off switching element 10 based on such sensing. Also, this embodiment is not limited to a configuration in which an abnormality in or normality of the voltage drop of the LEDs 2 is sensed, and a configuration is possible in which a temperature sensor (not shown) is disposed in the vicinity of the LEDs 2, and the control apparatus 11 controls the on/off state of the cut-off switching element 10 based on the temperature sensed by the temperature sensor. Also, this embodiment is not limited to a configuration in which an abnormality in or normality of the LEDs 2 is sensed, and a configuration is possible in which an abnormality in the control apparatus 11 is sensed, and the cut-off switching element 10 is switched off based on such sensing. In this case, a separate OR circuit (not shown) may be provided in order to control the on/off state of the cut-off switching element 10. With any of these configurations, it is possible to sense an abnormality in the LED drive circuit 1 and protect the coil 5.

Also, in the above embodiment, the voltage applied to the voltage sensing resistor 9 is sensed, and the cut-off switching element 10 is switched off, but the means for voltage sensing is not limited to this configuration. For example, a configuration is possible in which a separate voltage sensing circuit (not shown) is provided on the cathode side of the LEDs 2, and voltage sensing is performed by this circuit. With this configuration as well, the voltage drop in the LEDs 2 can be sensed, and the on/off state of the cut-off switching element 10 can be controlled based on such sensing. This enables preventing abnormal operation of the LEDs 2. Note that in this case, the voltage sensing resistor 9 functions as a member for allowing a very small current to flow to the LEDs 2.

Also, although there are no particular limitations on the withstand voltage of the various constituent elements in the LED drive circuit 1, a configuration is possible in which, for example, the withstand voltage of the rectifying element 6 is 100 V, the withstand voltage of the transfer switching element 7 is 100 V, and the withstand voltage of the cut-off switching element 10 is 200 V.

REFERENCE SIGNS LIST

1 LED drive circuit
2 LED
3 first DC power supply
4 second DC power supply
5 coil
6 rectifying element
7 transfer switching element
8 current sensing resistor
9 voltage sensing resistor (voltage sensing element)
10 cut-off switching element
11 control apparatus
21 first closed circuit
22 second closed circuit

The invention claimed is:

1. An LED drive circuit comprising:

a plurality of LEDs that are connected in series;

a first DC power supply that is connected in series to the plurality of LEDs so as to apply a forward bias to the plurality of LEDs;

a second DC power supply that is connected in series to the first DC power supply and is connected to the plurality of LEDs so as to apply a forward bias to the plurality of LEDs;

a coil that is connected in series with the plurality of LEDs and can accumulate energy from current generated by the first DC power supply and the second DC power supply;

a rectifying element whose cathode is connected between the first DC power supply and the second DC power supply, wherein the rectifying element is configured to allow current to flow from the plurality of LEDs to between the first DC power supply and the second DC power supply;

a transfer switching element that is connected to an anode of the rectifying element, wherein the transfer switching element is configured to connect the plurality of LEDs and the first power supply when the transfer switching element is switched on and is configured to allow current to flow from the plurality of LEDs to the rectifying element when the transfer switching element is switched off; and a control unit for controlling the transfer switching element, wherein a first closed circuit is formed by the plurality of LEDs, the first DC power supply, the second DC power supply, and the coil when the transfer switching element is switched on under control of the control unit, and a second closed circuit is formed by the plurality of LEDs, the second DC power supply, the coil, and the rectifying element when the transfer switching element is switched off under control of the control apparatus.

2. The LED drive circuit according to claim 1, wherein a voltage of the second DC power supply is lower than a required voltage of the second closed circuit, and a sum of a voltage of the first DC power supply and the voltage of the second DC power supply is greater than a required voltage of the first closed circuit.

3. The LED drive circuit according to claim 1, further comprising:

a voltage sensing element for sensing a voltage drop in the plurality of LEDs; and a cut-off switching element for cutting off the first closed circuit and the second closed circuit, wherein the control apparatus controls the on/off state of the cut-off switching element based on the voltage sensing performed by the voltage sensing element.

4. The LED drive circuit according to any of claims 1 to 3, wherein the plurality of LEDs are each an ultraviolet LED, and the LED drive circuit is disposed in an ultraviolet irradiation apparatus.

* * * * *